US007076190B2

(12) United States Patent
Jeon

(10) Patent No.: US 7,076,190 B2
(45) Date of Patent: Jul. 11, 2006

(54) DEVELOPING UNIT FOR ELECTROPHOTOGRAPHIC IMAGE FORMING APPARATUS

(75) Inventor: In-cheol Jeon, Suwon-si (KR)

(73) Assignee: Samsung Electronics Co., Ltd., Suon-si (KR)

( * ) Notice: Subject to any disclaimer, the term of this patent is extended or adjusted under 35 U.S.C. 154(b) by 32 days.

(21) Appl. No.: 10/866,687

(22) Filed: Jun. 15, 2004

(65) Prior Publication Data

US 2005/0063733 A1 Mar. 24, 2005

(30) Foreign Application Priority Data

Sep. 18, 2003 (KR) ..... 10-2003-0064720

(51) Int. Cl.
*G03G 15/00* (2006.01)

(52) U.S. Cl. ..... 399/167; 399/119

(58) Field of Classification Search ..... 399/111, 399/113, 116, 117, 119, 167
See application file for complete search history.

(56) References Cited

U.S. PATENT DOCUMENTS 5,950,048 A * 9/1999 Okumura et al. ..... 399/113

FOREIGN PATENT DOCUMENTS

| | | |
|---|---|---|
| JP | 5-035076 | 2/1993 |
| JP | 7-199648 | 8/1995 |
| JP | 2000-75623 | 3/2000 |

* cited by examiner

*Primary Examiner*—Hoang Ngo
(74) *Attorney, Agent, or Firm*—Roylance Abrams Berdo & Goodman, LLP

(57) ABSTRACT

A developing unit for an electrophotographic image forming apparatus is provided. The developing unit is rotatably installed in a photosensitive unit on which a photosensitive drum is mounted, centering on a hinge, and comprises a developing roller. The developing roller faces the photosensitive drum, is rotated, and develops an electrostatic latent image formed on the photosensitive drum. A center of a first idle gear to which a driving force is primarily transferred from a photosensitive drum gear formed as a single body in the photosensitive drum, is placed in the center of the hinge between the photosensitive drum gear and a developing roller gear formed as a single body in the developing roller.

18 Claims, 5 Drawing Sheets

DEVELOPING UNIT FOR ELECTROPHOTOGRAPHIC IMAGE FORMING APPARATUS

PRIORITY

This application claims the benefit under 35 U.S.C. §119 (a) of Korean Patent Application No. 2003-64720, filed on Sep. 18, 2003, in the Korean Intellectual Property Office, the entire disclosure of which is hereby incorporated by reference.

BACKGROUND OF THE INVENTION

1. Field of the Invention

The present invention relates to a developing unit for an electrophotographic image forming apparatus. More particularly, the present invention relates to a developing unit for an electrophotographic image forming apparatus, which makes the rotation of a developing roller gear formed as a single body in a developing roller uniform, thereby improving an image quality.

2. Description of the Related Art

In general, image forming apparatuses form an electrostatic latent image corresponding to a desired image by radiating light on a photosensitive body, supply a developing agent to the electrostatic latent image, develop the electrostatic latent image with the developing agent, and print the developed image on a sheet of paper through both transfer and fusing operations.

FIG. 1 schematically illustrates a gearing train of a conventional developing unit for an electrophotographic image forming apparatus. Referring to FIG. 1, the conventional developing unit 20 for an electrophotographic image forming apparatus is rotatably installed in a photosensitive unit 10 on which a photosensitive drum is mounted, centering on a hinge 30. Here, the developing unit 20 includes a developing roller which faces the photosensitive drum, is rotated, and develops an electrostatic latent image formed on the photosensitive drum, a developing agent supplying roller which supplies a developing agent to the developing roller, and a developing agent agitating unit which agitates the developing agent. A photosensitive drum gear 11, a developing roller gear 21, a developing agent supplying gear 22, and a developing agent agitating gear 23 are formed as a single body in the photosensitive drum, the developing roller, the developing agent supplying roller, and the developing agent agitating unit, respectively.

In the above structure, if a printing operation is performed, a driving force is transferred from a driving unit disposed in a main body of an image forming apparatus to the photosensitive drum gear 11, and the driving force is transferred to the developing roller gear 21 through the photosensitive drum gear 11. The driving force transferred to the developing roller gear 21 passes idle gears 24, 25, and 26 sequentially and causes the developing agent supplying gear 22 and the developing agent agitating gear 23 to rotate.

In this procedure, in order to prevent a variation in an axis-to-axis distance between the photosensitive drum and the developing roller caused by the driving force, a force 41 is applied to the developing unit 20. Specifically, as shown in FIG. 2, a repulsive force F caused by the driving force is generated between the photosensitive drum gear 11 and the developing roller gear 21 in a direction of a pressure angle β of a gear. As shown in FIG. 3, the axis-to-axis distance between the photosensitive drum and the developing roller repeatedly varies by a perpendicular force component Fx of the repulsive force F in a segment where the center of the hinge 30 and a rotating portion of the developing roller gear 21 are connected to each other. Thus, in order to prevent the variation in the axis-to-axis distance between the photosensitive drum and the developing roller caused by the driving force, a force 41 is applied to the developing unit 20. Fy of FIG. 2 denotes a force component in a direction of a segment where the center of the hinge 30 and the rotating portion of the developing roller gear 21 are connected to each other. Reference numeral 21' of FIG. 3 denotes a developing roller gear of which position varies by the driving force.

However, even though the force 41 is applied to the developing unit 20 as described above, as shown in FIG. 4, the axis-to-axis distance between a photosensitive drum 51 and a developing roller 61 repeatedly and finely varies by the repulsive force F caused by the driving force. The fine variation in the axis-to-axis distance between the photosensitive drum 51 and the developing roller 61 causes overlapping and separation between a pitch circle 12 of the photosensitive drum gear 11 and a pitch circle 22 of the developing roller gear 21 together with a variation in the amount of a nip between the photosensitive drum 51 and the developing roller 61 (see FIG. 5). Reference numeral 61' of FIG. 4 denotes a developing roller of which position finely varies by the driving force. Reference numeral 22' of FIG. 5 denotes a pitch circle of the developing roller gear 21 overlapping with the pitch circle 12 of the photosensitive drum gear 11, and reference numeral 22" of FIG. 5 denotes a pitch circle of the developing roller gear 21 spaced apart from the pitch circle 12 of the photosensitive drum gear 11. If the axis-to-axis distance between the photosensitive drum 51 and the developing roller 61 repeatedly varies, contact between the pitch circle 12 of the photosensitive drum gear 11 and the pitch circle 22 of the developing roller gear 21 becomes nonuniform. The nonuniform contact between the pitch circles 12 and 22 disadvantageously causes jitter in an image.

SUMMARY OF THE INVENTION

The present invention provides a developing unit for an electrophotographic image forming apparatus, which makes the rotation of a developing roller gear formed as a single body in a developing roller uniform, thereby improving an image quality.

According to an aspect of the present invention, there is provided a developing unit for an electrophotographic image forming apparatus, the developing unit being rotatably installed in a photosensitive unit on which a photosensitive drum is mounted, centering on a hinge, and comprising a developing roller, which faces the photosensitive drum, is rotated, and develops an electrostatic latent image formed on the photosensitive drum. A center of a first idle gear to which a driving force is primarily transferred from a photosensitive drum gear formed as a single body in the photosensitive drum, is placed in the center of the hinge between the photosensitive drum gear and a developing roller gear formed as a single body in the developing roller.

A second idle gear which transfers the driving force of the first idle gear to the developing roller gear, may be disposed between the first idle gear and the developing roller gear.

The unit may further comprise a developing agent supplying roller which supplies a developing agent to the developing roller and a developing agent supplying gear which is formed as a single body in the developing agent supplying roller. Here, the driving force may be transferred from the second idle gear to the developing agent supplying gear.

The unit may further comprise a developing agent agitating unit which agitates the developing agent supplied to the developing roller and a developing agent agitating gear which is formed as a single body in the developing agent agitating unit. Here, a third idle gear which transfers the driving force of the second idle gear to the developing agent agitating gear, may be disposed between the second idle gear and the developing agent agitating gear.

BRIEF DESCRIPTION OF THE DRAWINGS

The above and other aspects of the present invention will become more apparent by describing in detail an exemplary embodiment thereof with reference to the attached drawings in which.

Throughout the drawings it should be understood that like reference numbers are used to depict like features and structures.

DETAILED DESCRIPTION OF THE INVENTION

Hereinafter, an exemplary embodiment of the present invention will be described in detail with reference to the attached drawings.

Figure 1:
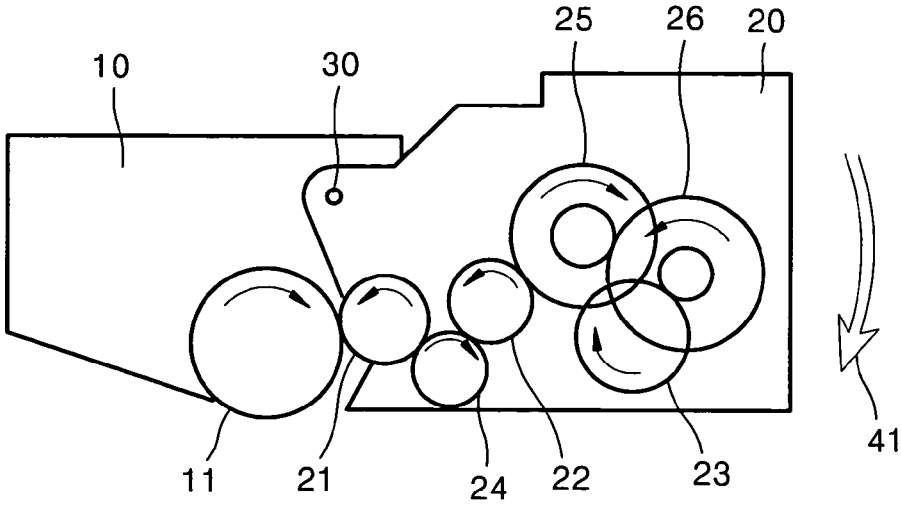
FIG. 1 (PRIOR ART)
FIG. 1 schematically illustrates a gearing train of a conventional developing unit for an electrophotographic image forming apparatus.
Figure 2:
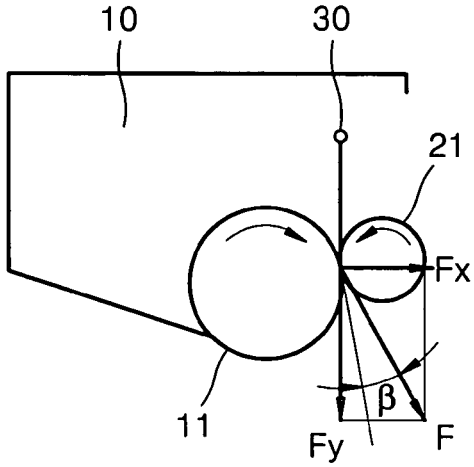
FIG. 2 (PRIOR ART)
FIGS. 2 through 5 respectively illustrate the operation of the gearing train in the developing unit for an electrophotographic image forming apparatus of FIG. 1.
Figure 3:
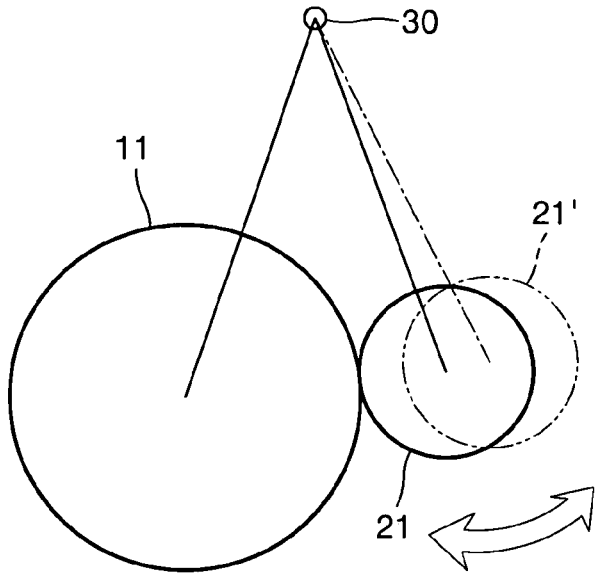
FIG. 3 (PRIOR ART)
Figure 4:
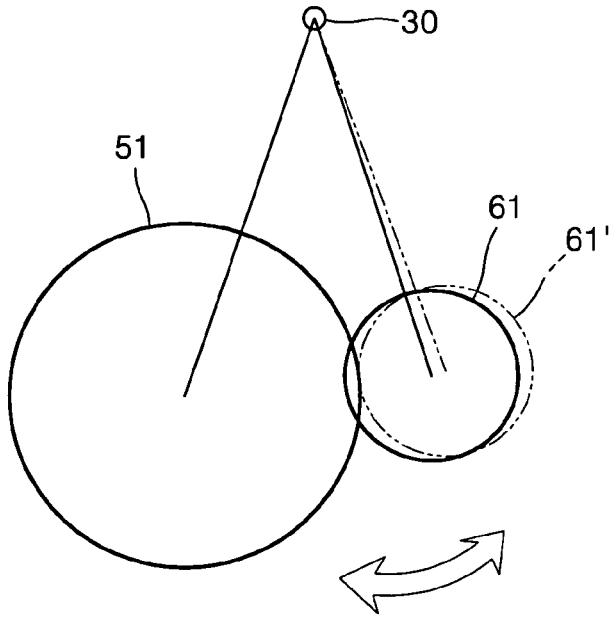
FIG. 4 (PRIOR ART)
Figure 5:
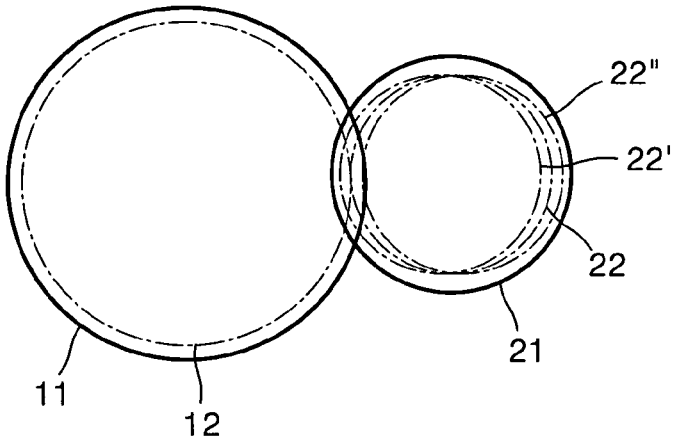
FIG. 5 (PRIOR ART)
Figure 6:
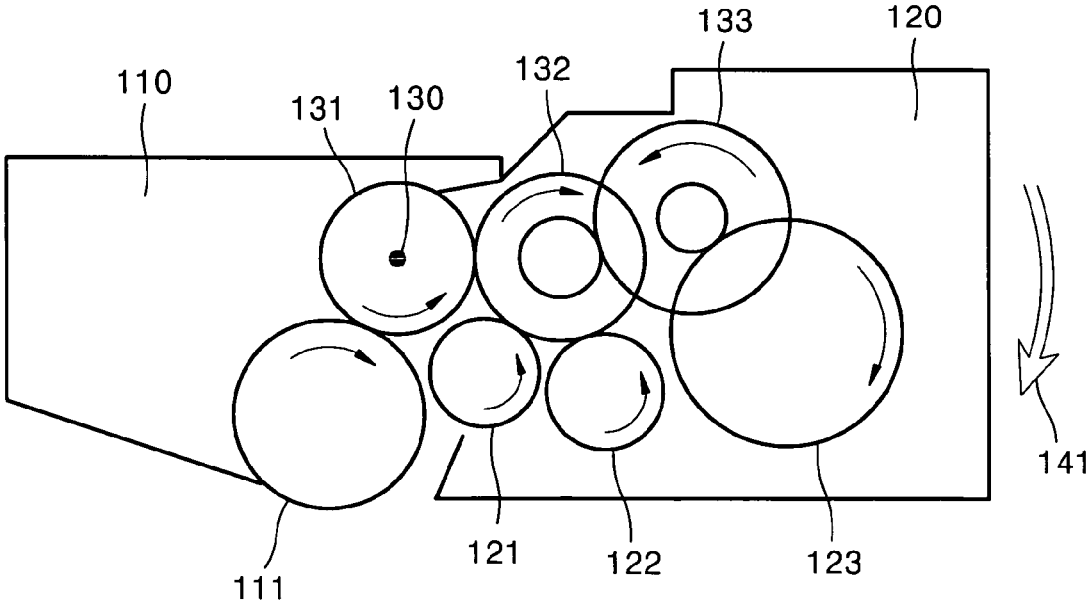
FIG. 6 schematically illustrates a gearing train of a developing unit for an electrophotographic image forming apparatus according to an embodiment of the present invention.
Figure 8:
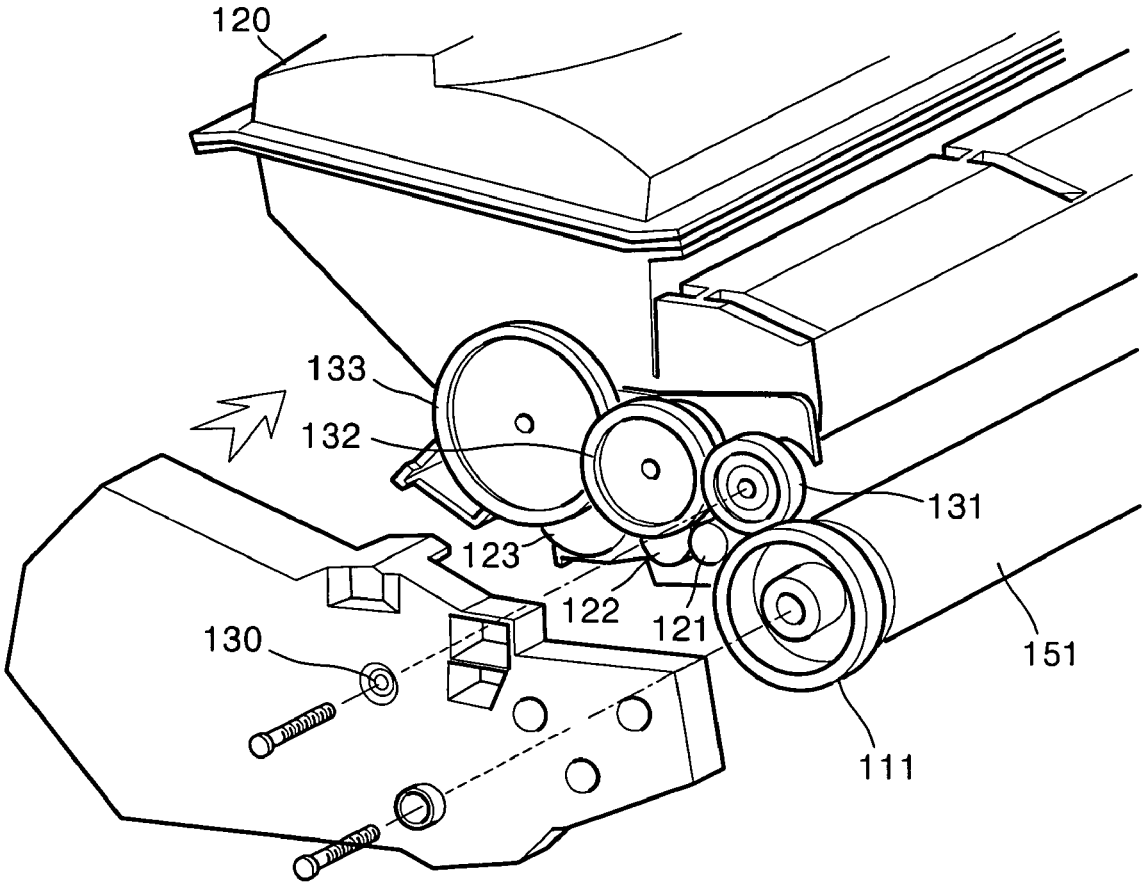
FIG. 8 is an exploded view illustrating a developing unit for an electrophotographic image forming apparatus according to an embodiment of the present invention.

FIG. 6 schematically illustrates a gearing train of a developing unit for an electrophotographic image forming apparatus according to an embodiment of the present invention. FIG. 8 is an exploded view illustrating a developing unit for an electrophotographic image forming apparatus according to an embodiment of the present invention.

Referring to FIGS. 6 and 8, a developing unit 120 for an electrophotographic image forming apparatus according to the embodiment of the present invention is rotatably installed in a photosensitive unit 110 centering on a hinge 130. A photosensitive drum 151 in which an electrostatic latent image is formed, is rotatably mounted on the photosensitive unit 110. The developing unit 120 includes a developing roller (not shown) which faces the photosensitive drum 151, is rotated, and develops an electrostatic latent image formed on the photosensitive drum 151, a developing agent supplying roller (not shown) which supplies a developing agent to the developing roller, and a developing agent agitating unit (not shown) which agitates the developing agent supplied to the developing roller. Here, a photosensitive drum gear 111, a developing roller gear 121, a developing agent supplying gear 122, and a developing agent agitating gear 123 are formed as a single body with the photosensitive drum 151, the developing roller, the developing agent supplying roller, and the developing agent agitating unit, respectively.

Meanwhile, the developing unit 120 includes first, second, and third idle gears 131, 132, and 133, which are disposed between the aforementioned gears and transfer a driving force.

The center of the first idle gear 131 is placed in the center of the hinge 130, and the driving force is primarily transferred from the photosensitive drum gear 111 to the first idle gear 131.

The driving force is transferred from the first idle gear 131 to the second idle gear 132 so that the developing roller gear 121 and the developing agent supplying gear 122 are rotated.

In addition, the driving force is transferred from the second idle gear 132 to the third idle gear 133 so that the developing agent agitating gear 123 is rotated.

In the above structure, if a printing operation is performed, a driving force is transferred from a driving unit disposed in a main body of an image forming apparatus to the photosensitive drum gear 111, and due to the driving force, the photosensitive drum 151 is rotated. The driving force transferred to the photosensitive drum gear 111 is transferred to the first idle gear 131 whose center is placed in the center of the hinge 130.

Subsequently, the driving force transferred to the first idle gear 131 is transferred to the developing roller gear 121 and the developing agent supplying gear 122 through the second idle gear 132, and due to the driving force, the developing roller and the developing agent supplying roller are rotated.

The driving force transferred to the second idle gear 132 is transferred to the developing agent agitating gear 123 through the third idle gear 133, and due to the driving force, the developing agent agitating unit is rotated.

Figure 7:
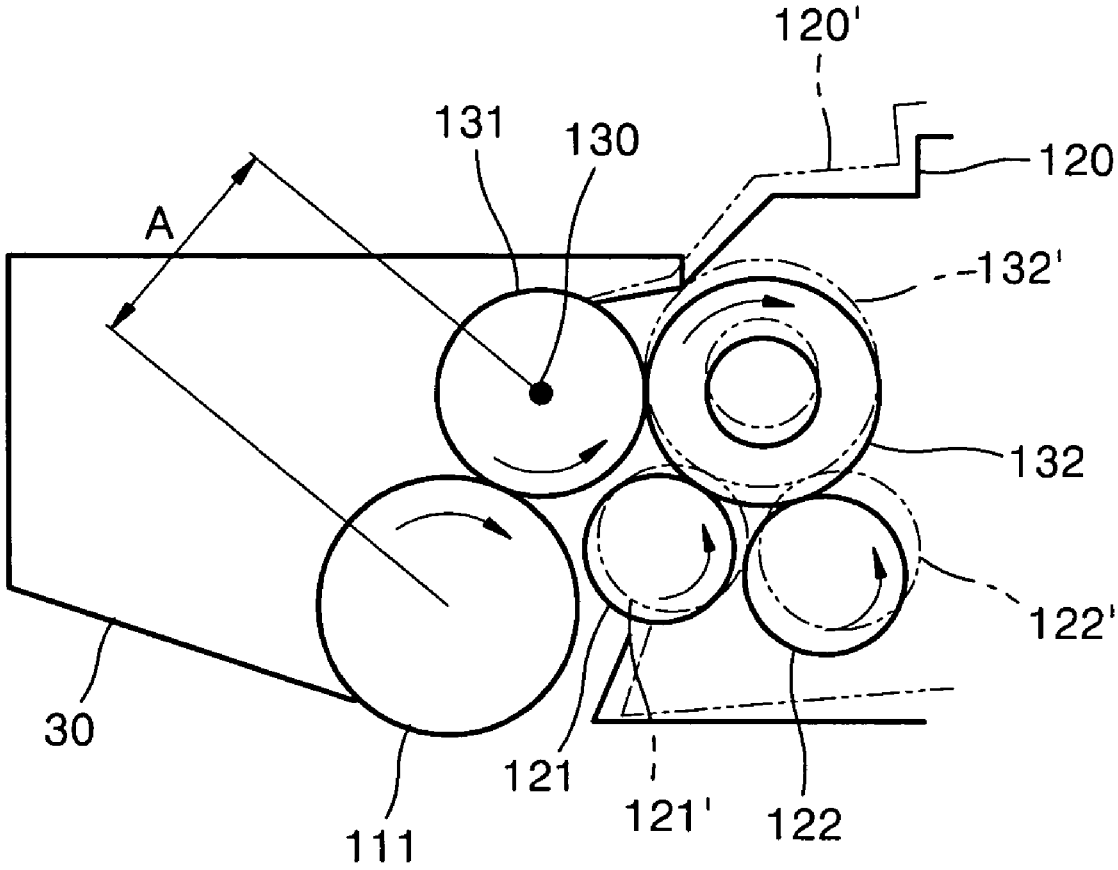
FIG. 7 illustrates the operation of the gearing train in the developing unit for an electrophotographic image forming apparatus of FIG. 6.

In this example, like in conventional devices, in order to prevent a variation in an axis-to-axis distance between the photosensitive drum 151 and the developing roller caused by the driving force, a force 141 is applied to the developing unit 120. Meanwhile, referring to FIG. 7, even though the force 141 is applied to the developing unit 120, due to the driving force, a center-to-center distance between the photosensitive drum gear 111 and the developing roller gear 121 varies finely. Reference numerals 120', 121', 122', and 132' denote a developing unit, a developing roller gear, a developing agent supplying gear, and a second idle gear, respectively, whose center-to-center distance therebetween vary finely.

However, in the present invention, the driving force is primarily transferred from the photosensitive drum gear 111 to the first idle gear 131 whose center is placed in the center of the hinge 130, and the developing roller gear 121, the developing agent supplying roller 122, and the developing agent agitating gear 123 are rotated through the second and third idle gears 132 and 133, such that a predetermined distance A between the center of the photosensitive drum gear 111 and the center of the hinge 130 is constant during the printing operation. As a result, the rotation of the developing roller gear 121 formed as a single body in the developing roller is made uniform, thereby preventing jitter in an image.

As described above, the developing unit for an electrophotographic image forming apparatus according to an embodiment of the present invention has at least the following effects. First, a distance between the center of a photosensitive drum gear and the center of a hinge is constant during a printing operation, such that the rotation of a gear is made uniform. As such, jitter in an image is prevented. Second, in order to prevent a variation in a center-to-center distance between the photosensitive drum gear and the developing roller gear caused by the driving force, an excessive force is used in conventional printers. The excessive force causes the life span of an image forming apparatus to be reduced and causes an image quality to lower. However, in embodiments of the present invention, a distance between all gears in the image forming apparatus is uniform, such that a margin in designing a force is obtained. Third, in order to prevent jitter in an image that may occur by driving the gear, preferably, all gears in the image forming apparatus are disposed in one component. In embodiments of the present invention, the driving force is primarily transferred from the photosensitive drum gear to a first idle gear whose center is placed in the center of the hinge, and the developing roller gear, the developing agent supplying roller, and the developing agent agitating gear 123 are rotated through the second and third idle gears, such that all gears substantially exist in one component.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A developing unit for an electrophotographic image forming apparatus, the developing unit being rotatably installed in a photosensitive unit on which a photosensitive drum is mounted, centering on a hinge, and comprising:

a developing roller, which faces the photosensitive drum, is rotated, and develops an electrostatic latent image formed on the photosensitive drum, wherein a center of a first idle gear to which a driving force is primarily transferred from a photosensitive drum gear formed as a single body in the photosensitive drum, is placed in the center of the hinge between the photosensitive drum gear and a developing roller gear formed as a single body in the developing roller.

2. The unit of claim 1, wherein a second idle gear which transfers the driving force of the first idle gear to the developing roller gear, is disposed between the first idle gear and the developing roller gear.

3. The unit of claim 2, further comprising a developing agent supplying roller which supplies a developing agent to the developing roller and a developing agent supplying gear which is formed as a single body in the developing agent supplying roller.

4. The unit of claim 3, wherein the driving force is transferred from the second idle gear to the developing agent supplying gear.

5. The unit of claim 2, further comprising a developing agent agitating unit which agitates the developing agent supplied to the developing roller and a developing agent agitating gear which is formed as a single body in the developing agent agitating unit.

6. The unit of claim 5, wherein a third idle gear which transfers the driving force of the second idle gear to the developing agent agitating gear, is disposed between the second idle gear and the developing agent agitating gear.

7. A method of operating an electrophotographic image forming apparatus having a developing unit rotatably installed in a photosensitive unit on which a photosensitive drum is mounted centered on a hinge, comprising the steps of:

rotating a developing roller which faces the photosensitive drum to develop an electrostatic latent image formed on the photosensitive drum;

transferring a driving force from a photosensitive drum gear formed as a single body with the photosensitive drum to a first idle gear placed in the center of the hinge between the photosensitive drum gear and a developing roller gear formed as a single body with the developing roller.

8. The method of claim 7, further comprising transferring the driving force to the developing roller gear via a second idle gear disposed between the first idle gear and the developing roller.

9. The method of claim 8, further comprising supplying a developing agent to the developing roller with a developing agent supplying roller via a developing agent supplying gear which is formed as a single body with the developing agent supplying roller.

10. The method of claim 9, further comprising transferring the driving force from the second idle gear to the developing agent supplying gear.

11. The method of claim 8, further comprising agitating the developing agent with a developing agent agitating unit via a developing agent agitating gear formed as a single body with the developing agent agitating unit.

12. The method of claim 11, further comprising transferring the driving force from the second idle gear to the developing agent agitating gear via a third idle gear disposed between the second idle gear and the developing agent agitating gear.

13. A developing unit for an electrophotographic image forming apparatus, the developing unit being rotatably installed about hinge with a first axis in a photosensitive unit on which a photosensitive drum is mounted, the developing unit comprising:

a photosensitive drum gear formed on the photosensitive drum;

a developing roller that faces the photosensitive drum and rotates, the developing roller developing an electrostatic latent image formed on the photosensitive drum;

a developing roller gear formed on the developing roller;

a first idle gear connected to the photosensitive drum gear to receive a driving force from the photosensitive drum gear, the first idle gear rotating about the first axis of the hinge.

14. The unit of claim 13, further comprising a second idle gear connecting the first idle gear and the developing roller gear to transfer the driving force from the first idle gear to the developing roller gear.

15. The unit of claim 14, further comprising a developing agent supplying roller which supplies a developing agent to the developing roller and a developing agent supplying gear formed on the developing agent supplying roller.

16. The unit of claim 15, wherein the driving force is transferred from the second idle gear to the developing agent supplying gear.

17. The unit of claim 16, further comprising a developing agent agitating unit which agitates the developing agent supplied to the developing roller and a developing agent agitating gear which is formed on the developing agent agitating unit.

18. The unit of claim 17, further comprising a third idle gear connecting the second idle gear and the developing agent agitating gear to transfer the driving force of the second idle gear to the developing roller gear.

* * * * *